US005227118A

United States Patent [19]

Bleser et al.

[11] Patent Number: 5,227,118

[45] Date of Patent: Jul. 13, 1993

[54] TOP BLOWING REFINING LANCE

[75] Inventors: Victor Bleser, Differdange; Andre Bock, Luxembourg; Patrick Derungs, Garnich; Carlo Heintz, Luxembourg; Carlo Lux, Bertrange; Robert Mousel; Francois Witry, both of Dudelange, all of Luxembourg

[73] Assignee: Arbed S.A., Luxembourg

[21] Appl. No.: 803,167

[22] Filed: Dec. 6, 1991

[30] Foreign Application Priority Data

Dec. 10, 1990 [LU] Luxembourg ..... 87,855

[51] Int. Cl.[5] ..... C21C 5/32

[52] U.S. Cl. ..... 266/225; 266/266

[58] Field of Search ..... 266/225, 226, 266

[56] References Cited

U.S. PATENT DOCUMENTS 4,746,103 5/1988 Takashiba et al. ..... 266/225

4,993,691 2/1991 Mousel et al. ..... 266/225

FOREIGN PATENT DOCUMENTS 789589 12/1980 U.S.S.R. ..... 266/226

*Primary Examiner*—Melvyn J. Andrews

*Attorney, Agent, or Firm*—Fishman, Dionne & Cantor

[57] ABSTRACT

The present invention relates to a refining lance. It relates more particularly to a lance of the kind used for supplying from above, onto a metal bath, the oxidizing gas required for refining the molten metal contained in a metallurgical vessel. It includes a rotating device to divide the refining gas flow into an even number of separate gas jets that are more or less identical. The gas jets exit the head of the lance in angles which are substantially equal with respect to the longitudinal axis of the lance but in diametrically opposite directions with respect to the said axis.

18 Claims, 4 Drawing Sheets

TOP BLOWING REFINING LANCE

BACKGROUND OF THE INVENTION

During the process of refining a hot metal or an iron alloy, an oxidizing gas, mostly pure oxygen, is used. The oxygen is injected or blown from above onto a liquid metal bath in a metallurgical vessel, and it is of the utmost importance to be able to modify or vary the characteristics of the stream of the oxidizing gas, as well as its impact point on the surface of the bath, all depending on the state of progression of the refining process. This is all the more true since modern refining technologies use supersonic primary jets for oxidizing gas.

The design of a gas blowing lance, which is used in connection with a refining process of the kind described herebefore, is a rather intricate, matter. Indeed, the oxidizing gas must be able to react with the metallic bath to allow reactions like the decarburization of the iron to take place, and it must also be able to guarantee a post-combustion above the surface of the bath of the carbon monoxide generated as a result of the decarburization reaction. In addition the flow rate, i.e. the volume per unit time, of the oxidizing gas blown into the vessel must be regulated independently from the jet velocity of the gas. Moreover it is desireable to move the location where the gas jet impinges on the bath across the surface of the bath during the refining operation. This enlarges the area where the metallurgical reactions take place and intensifies the bath mixing effect of the jet. Also, the oxygen for post-combustion must be spread out over the most extended possible reaction area on the surface of the bath, while at the same time it must be guaranteed that the post-combustion of the carbon monoxide takes place in proximity to the surface of the bath and not in the upper parts of the vessel where the liberated energy could create a risk for the lance and/or the vessel mouth.

Luxembourg Patent No. 86 322 (corresponding to U.S. Pat. No. 4,730,784, both of which are assigned to the assignee hereof and are fully incorporated herein by reference thereto) relates to a nozzle of an oxygen blowing lance which allows for independent regulation of the exit velocity (Mach number) and the flow rate of the oxygen stream. A later development of such a refining lance, which has been disclosed in Luxembourg Patent No. 87 353 (corresponding to U.S. Pat. No. 4,993,691, both of which are assigned to assignee hereof and fully incorporated herein by reference thereto), makes it possible for the operator to vary, as a function of the different refining phases, the quantity of the primary oxygen supplied to the bath, while simultaneously imposing the required optimal shape and velocity on the oxygen jet. According to the device in U.S. Pat. No. 4,993,691 the refining lance is equipped with a nozzle to shape and to guide the primary oxygen jet. This nozzle comprises a conduit with a variable cross section which defines first a converging passage, then a throat passage and finally a diverging passage. The nozzle comprises a central body which is movable along the axis of the nozzle at the level of the throat. This central body has the shape of a substantially cylindrical body part followed by a nose streamlining in a concave way towards a conical point. By moving this central body, the free cross section of the throat and the shape of the divergent passage can be modified, and, as a consequence hereof, the characteristics of the nozzle can be continuously adjusted.

Luxembourg Patent No. 86 321 (corresponding to U.S. Pat. No. 4,730,813, both of which are assigned to the assignee hereof and are fully incorporated herein by reference thereto) discloses a device which, in conjuction with an oxygen top blowing refining lance, allows the oxygen jet coming out of the head of the lance to be deviated, within given limits, with respect to the axis of the lance and may thus be directed onto various impact points on the surface of the liquid bath to be refined. The device in said U.S. Pat. No. 4,730,813 includes a chamber having substantially the shape of a truncated pear in the vicinity of the outlet of the lance head. Through the action of gas jets in the vicinity of the outlet level of the nozzle which impinge laterally on the main jet of primary oxygen leaving the nozzle, the main jet is deviated towards one side of the pear-shaped chamber and moves along the walls of the chamber on the opposite side from where the lateral deviating jets originate. This causes the oxygen stream, which is at supersonic speed, to exit from the outlet of the lance head at a given angle with respect to the axis of the lance. The angle of deviation of the oxygen stream depends to a large extent on the shape of the wall of the chamber. By providing several orifices for the lateral gas jets and by directing the jets one after the other against the main refining gas stream, the impact point of this stream on the surface of the metal bath can be shifted along the circumference of a circle, and, depending on the position of the lateral jets responsible for the deviation, it can also be directed towards defined places on the surface of the bath.

Although it is thus possible to deviate the supersonic main refining oxygen stream, the lance is subject to important lateral reaction forces which strain the suspension and anchorage points of the lance body to such an extent that it becomes difficult in practice to figure out a reliable solution to these holding device related problems. Moreover the device of U.S. Pat. No. 4,730,813 only allows deviating the main stream of primary oxygen jet to some well defined specific places corresponding to the orifices of the lateral deviating jets.

SUMMARY OF THE INVENTION

While the prior art lances of U.S. Pat. Nos. 4,730,784 and 4,993,691 are suitable and effective for their intended purposes, the oxygen blowing lance of the present invention makes use of the device disclosed in the U.S. Pat. No. 4,993,691 and advantageously incorporates it into the new and improved design of the metal refining lance of this invention.

The lance of the present invention is an oxygen blowing lance which is able to generate a stream of gas, the speed and flow rates of which can be independently regulated whereby the impact point on the liquid bath surface can be continuously moved during the refining operation.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DETAILED DESCRIPTION OF THE PREFERRED EMBODIMENT

Figure 1A:
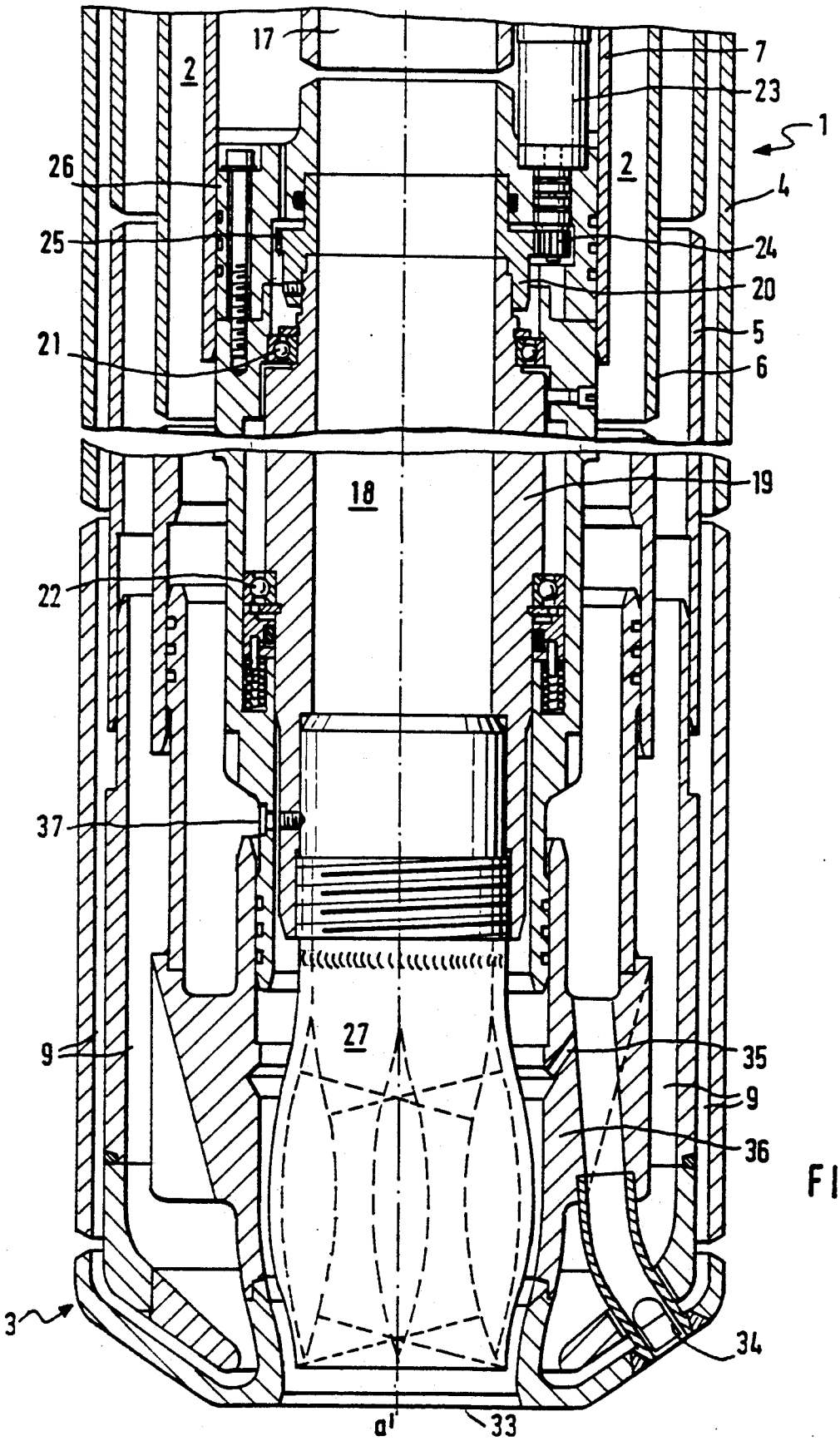
FIGS. 1*a* and 1*b* are axially successive longitudinal sections through the lance body of this invention, with FIG. 1*a* being downstream of FIG. 1*b*.
Figure 1B:
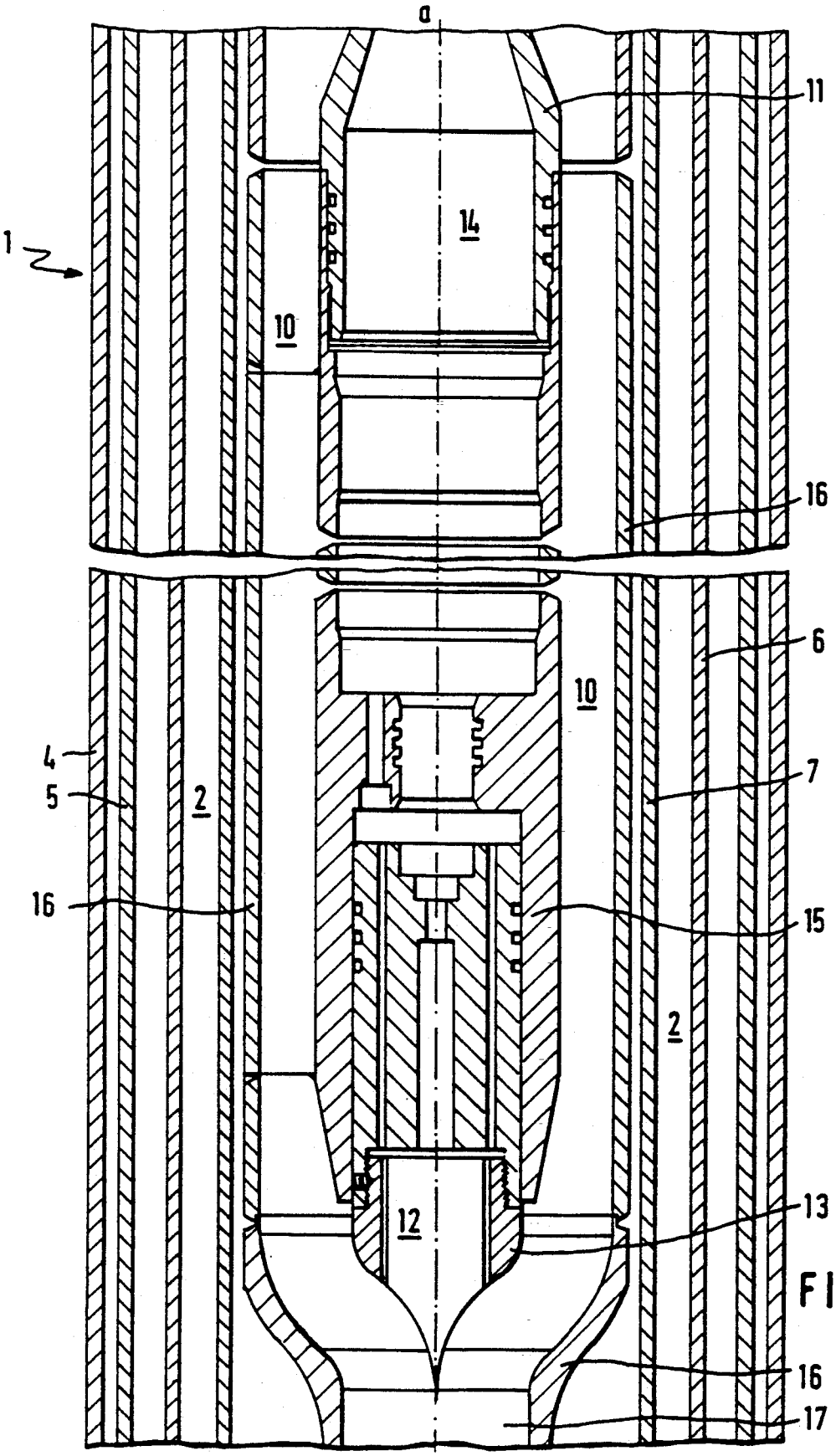

As shown in FIGS. 1*a* and 1*b*, the oxygen blowing lance 1 according to the invention has a lance head 3 which is welded to a lance body 2. Lance body 2 consists of a double mantle of four walls 4, 5, 6 and 7 made of concentric melded steel pipes which are kept spaced apart by spacers and are connected to the lance head 3, thus forming a water cooling circuit 9 between the walls 4, 5, and 6 and the walls of the lance head 3.

The suspension of the lance, as well as its fluid supplies, — oxygen, nitrogen and cooling water, — have not been shown in FIGS. 1*a* and 1*b* as they do not form part of the invention.

The inner wall 7 of the lance body 2 forms an annular chamber 10 crossed in the direction of its longitudinal axis *a*—*a'*by a concentric bearing shaft 11 supporting an assembly 12 which is part of a Laval nozzle configuration. The bearing shaft 11 is composed preferably of a pipe which allows the integration therein of electric connections (not shown in the FIGURES) for supplying electric current to the various control mechanisms which will be described hereinafter. According to another embodiment, the shaft 11 and the inner wall 7 may themselves act as conductors which will supply the electric current to the said control mechanisms.

The assembly 12 includes a translation element 13 which is connected to the supporting shaft 11 through the intermediary of a driving mechanism such as a linear servomotor 14 and a cylindrical sleeve 15 within which the translation element 13 can be moved in the direction of the axis *a*—*a'*of the refining lance 1. As can be seen in FIG. 1*b*, the end of the translation piece 13 has the shape of a kind of needle whose profile follows a continuous aerodynamic transition curve in order to minimize the generation of turbulence within the stream of the refining gas.

In the interior of the wall 7 of the double mantel forming the lance body 2, there is a concentric conduit 16 for the refining gas, i.e. the primary oxygen. At the level of the translation element 13 the concentric conduit 16 comprises first a converging part and then a throat, which, in cooperation with the needlelike translation element 13 form a Laval nozzle, the characteristics or parameters of which can be modified by moving the translation element 13 in the direction of the axis *a*—*a'*. This Laval nozzle allows for control of the flow rate of the refining gas independently of the supersonic velocity which the gas stream will have when leaving the Laval nozzle and centrally entering into a cylindrical part 17 of the conduit 16 at the outlet of the Laval nozzle. The operating procedure for the variable Laval nozzle 12 is described in more detail in U.S. Pat. No. 4,993,691.

Downstream of part 17 of the refining gas conduit 16, the oxygen blowing lance 1 includes a device 18 (see FIG. 1*a*) which is placed centrally in the flow of the supersonic gas stream and which separates this stream in an aerodynamically correct manner into two separate more or less equal supersonic jets. After leaving the separating device 18, these supersonic jets of refining gas enter into the head portion 3 of the lance, wherein they undergo a deflection by a given angle as will be explained hereinafter.

The separating device 18 is constructed so as to have the shape of a rotor whereof the upper cylindrical part 19 is rotatably suspended in a suspension and rotating device 20 comprising an upper bearing 21 and a lower bearing 22. In the illustrated embodiment the upper and lower bearings 21 and 22 of the rotor device 18 include ball-bearings, the casings of which are fixed in a tight but dismountable manner to the wall 7 of the lance body 2. The bearings and fixing means are shown in detail in the FIG. 1*a*, but it will be understood that this structure merely illustrates the preferred embodiment. Other bearing arrangements can also be employed, as long as they allow the technical execution of the present invention.

One or several servomotors 23, which are incorporated between the wall 7 of the lance body 2 and the conduit 16, to impart the rotating movement to the rotor 18 whereof the angular speed of rotor 18 may be selected in an appropriate range. To achieve this, the shaft of the servomotor 23 is equipped with a pinion 24 which drives a mating ring gear 25 provided on the suspension and rotating device 20.

The electrical connections for external power supply and for external motor-control of the servomotors 14 and 23 are located between the wall 7 and the conduit 16. Since these connections do not form part of the invention, they have not been shown in order not to overburden FIGS. 1*a* and 1*b* with nonessential details.

It should, however, be noted that in accordance with the preferred embodiment, the space between wall 7 and the conduit 16 is filled with an inert gas, such as for example nitrogen, which is under a slight pressurization as compared to the pressure of the refining gas, namely the oxygen flowing through the central gas duct 17 of the refining lance 1. This arrangement avoids penetration of oxygen into the space between wall 7 and conduit 10 which could lead to ignitions (i.e. fire or explosion) in the servomotors and in their connections. Also, in order to avoid static electric discharges between the different elements, in particular between the rotor and the fixed parts, equipotential measures, such as the equipotential connector 26, have been provided.

Figure 4:
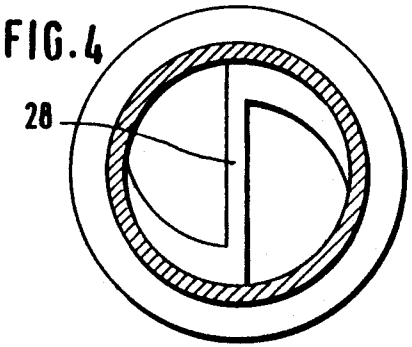
FIGS. 4, 5, and 6 are three cross sectional transverse views along the planes A—A, B—B and C—C of the FIGS. 2 and 3.
Figure 5:
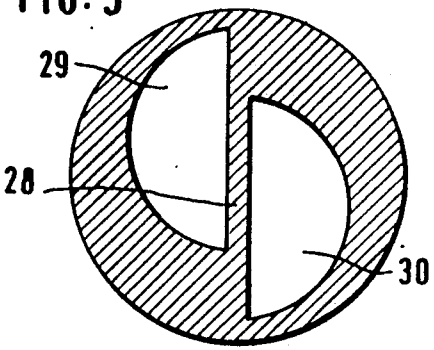
Figure 6:
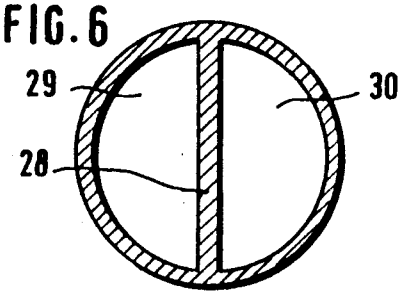
Figure 3:
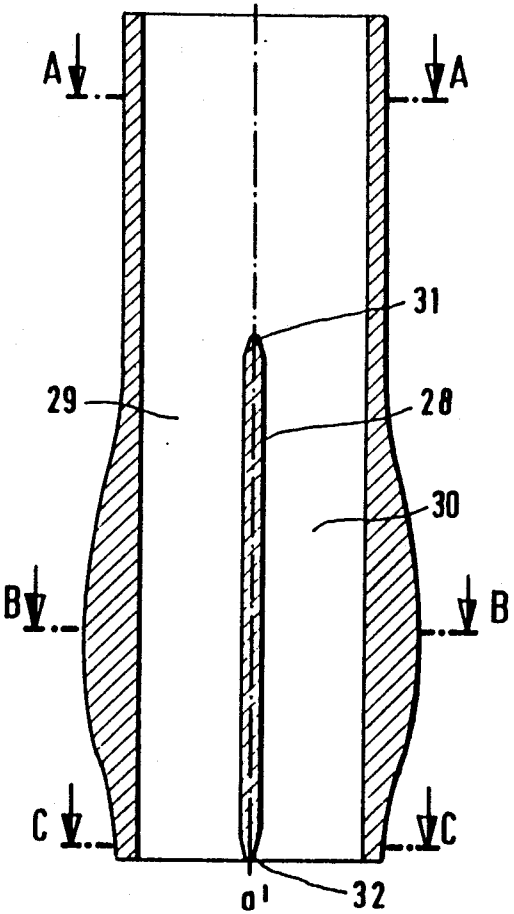
FIG. 3 is another longitudinal section through the head of the rotor of the lance, the view of which is offset by 90°with respect to the illustration shown in FIG. 2.
Figure 2:
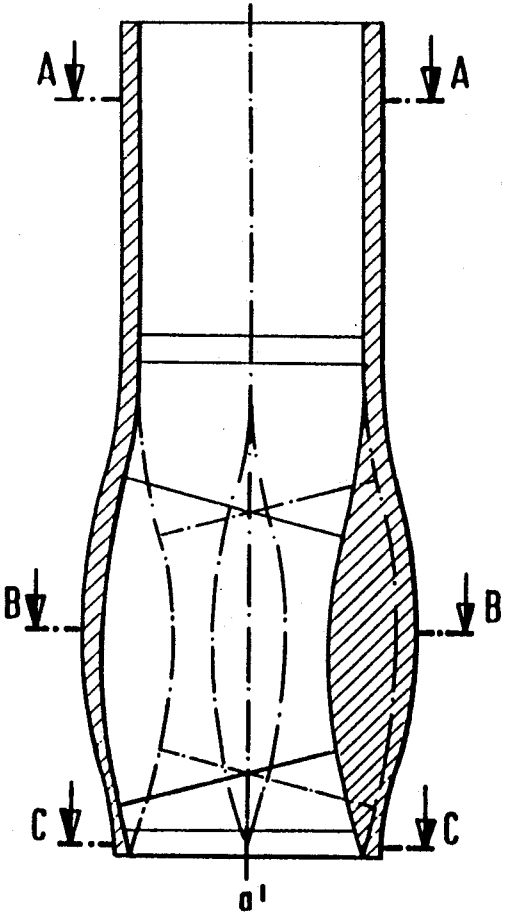
FIG. 2 is a longitudinal section through the head of the rotor of the lance according to the invention.

The rotating separation device 18 comprises mainly two parts, 19 and 27, which are separately connected to each other by appropriate means, as for example the screw means illustrated by part 37. The upper part 19, with an interior cylindrical shape, extends over a selected distance and, although it is rotating, it constitutes a stabilization path for the supersonic stream of refining gas. As can be seen from FIGS. 2 to 6, the lower part or blowing head 27 of the rotor 18 includes a partition wall 28 which divides rotor head 27 into two separate chambers 29, 30. The partition wall 28 has a pointed shape at the level of the impact point 31 of the inflowing stream of the refining gas as well as at the separation point 32 where the two divided jets exit the rotor. As seen in FIGS. 4 and 5, the inner walls of the chambers 29 and 30 in the head part 27 of rotor 18 are each shaped so as to have the form of a curved semicylinder, referred to herein as deflection semicylinders. As one can see on the cross sections B—B and C—C of the FIGS. 4 and 5, the two chambers 29 and 30 are displaced eccentrically with respect to each other and with respect to the central axis *a—a'* of the lance 1.

At its impact point 31 on the partition wall 28, the central supersonic stream of the refining gas is divided into two identical (or nearly identical) supersonic jets. These two jets flowing through the chambers 29 and 30, are deviated with respect to the axis *a—a'* of the lance 1 so as to exit from the head of the rotor 27 at given angles. Since the two chambers 29 and 30 are eccentric as defined above, no interference occurs between the two supersonic jets when they exit the head of the lance. The two supersonic jets are identical (or nearly identical) and they come out of the head of the rotor 27 under identical (or nearly identical) angles, but in two distinct directions which are diametrically opposed with respect to the axis *a—a'* of the lance 1. The lance itself is not subjected to radial dynamic forces because the forces due to the supersonic jets are neutralized in the device according to the invention since they compensate each other (except for the existence of a residual couple acting on the rotor). The fixing and guiding supports of the refining lance 1 according to the present invention are therefore not exposed to forces resulting from the deviation of the supersonic jet of refining gas with respect to the axis of the lance, as this was the case for the devices according to the state of the art described in U.S. Pat. No. 4,730,813.

According to another feature of the present invention, the head of the rotor 27 is driven in a rotating motion. As a result of that rotation, the impact points of the two jets of refining gas on the surface of the liquid metal bath are, during the refining process, continuously moved along a circle, the radius of which is determined by the deviation angle of the jets and by the distance between the head of the lance 3 and the metal bath below the lance. The deviation angle of the supersonic jet of the refining gas is a function of the curvature angles of the inner walls of the deflection chambers 29 and 30 (see, e.g. FIG. 2).

As can best be seen in FIG. 1*a*, the design of the head of the lance 3 has, in the preferred embodiment of the invention, been chosen so as to allow an easy and rapid mounting and dismounting on or from the body of the lance. This design therefore allows rapid exchange of all pieces subject to wear, either due to the influence of the high temperatures at which the lance operates, or from the splattering of liquid metal particles (called also slopping). The design moreover allows rapid exchange of the rotor head 27 if a different deviation angle of the refining gas jets is necessary or desired for particular use.

As can also be seen in FIG. 1*a*, the head of the rotor 27 is arranged slightly recessed with respect to the outlet orifice 33 of the head 3 of the lance. An annular gas flow, preferably, of oxygen, flows between the outer wall of the head of the rotor 27 and the inner wall of the head 3 of the lance. This annular flow has a subsonic velocity. It forms an envelope and provides thus some protection to the head of the rotor 27.

Post-combustion nozzles 34 are provided in the head 3 of the lance around the central orifice 33. In the preferred embodiment eight nozzles are provided. These nozzles are arranged regularly along the circumference of the lance head. Preferably the post-combustion nozzles 34 are of the "double Prandl-Meyer effect" type as described in Luxembourg Patent No. 87 354 (which is assigned to the assignee hereof). These nozzles build up a practically continuous screen around the two jets of refining gas. The post-combustion nozzles 34 are supplied with oxygen by a secondary gas stream flowing in the annular space between the walls 6 and 7 of the double mantel of the lance 1. This same secondary gas stream of subsonic velocity also supplies, via the orifices 35 disposed in the inner wall 36 of the lance head 3, the annular subsonic protection gas flow, for the rotor head 27 mentioned above.

The present invention places at the steelmaker's disposal, a special injection lance, for use in a refining process in a molten metal bath. In accordance with its design, this lance allows the characteristics of the stream of the refining gas to be modified even during the course of the refining operation by means of a variable Laval nozzle. The impact point of each separate jet of gas impinging the surface of the bath is moved through the intermediary of rotors 18 and head 27 for the division of the stream, and for the rotation and orientation of the generated separate jets. Accordingly, penetration of the supersonic refining gas jets into the molten metal bath and a mixing of the said bath can be guaranteed during the whole course of the refining process.

It is important to note that the lance has been conceived and designed so that during its operation it is not exposed to mechanical stresses which could diminish its operational efficiency. In addition, the flow of secondary gas protects the rotating parts against the destructive action of the slopping of molten metal particles, these jets of secondary gas also supplying the oxidizing gas required for the post-combustion of the reaction gases coming out of the bath during refining treatment thereof.

Figure 7:
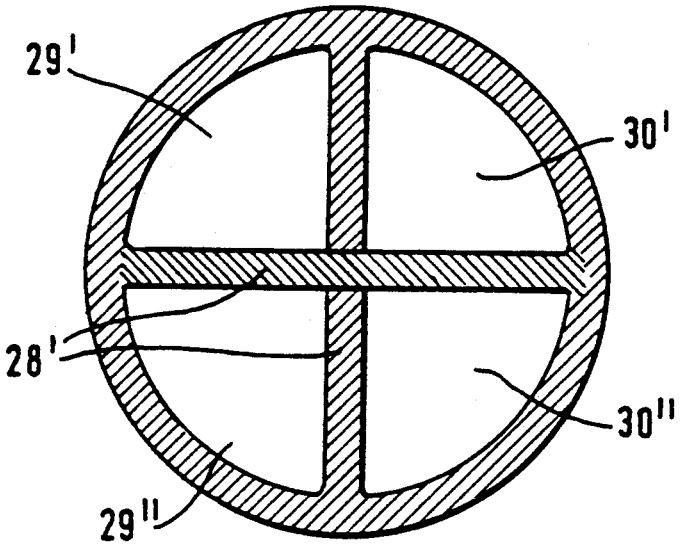
FIG. 7 is a section through the head of a four hole rotor at the level of the outlet.

Although one specific form of an embodiment has been presented to explain the invention, other execution forms complying with the scope of the invention are also possible. By way of example, the scope of this invention encompasses a rotating dividing means which subdivides a main supersonic stream of refining gas into two individual equal jets or into some other even number of identical separate jets. FIG. 7 shows a cross section through the orifice level—corresponding to the level C—C of FIG. 6 of a four jet lance. In this further embodiment according to the invention the partition wall 28 is cross-shaped and the corresponding subdivision of the primary gas main outflow channel comprises the four chambers 29', 29'', 30', 30''. For this embodiment too, no one of the four jets will interfere with any one of the other three jets.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A blowing lance for use in refining molten metal in a metallurgical vessel, the lance including:

a nozzle assembly, extending along an axis of the lance, for delivery of a gas to the molten metal;

separating means, located downstream of said nozzle assembly, to receive a gas stream from said nozzle assembly and to divide said gas stream into an even number of substantially identical gas jets for discharge from said lance at angles which are substantially equal and opposite with respect to the axis of the lance; and rotating means for rotating said separating means about the axis of the lance.

2. A blowing lance as in claim 1, including:

means for varying independently from each other the velocity and flow rate of gas flowing through said nozzle.

3. A blowing lance in claim 2, wherein:

said nozzle has the shape of a Laval nozzle to input supersonic velocity to the gas stream, said nozzle including control means to vary the nozzle passage to control flow rate and velocity of the gas stream.

4. A blowing lance as in claim 1, wherein:

said separating means comprises a cylinder, at least the downstream part of said cylinder being divided into an even number of equal chambers.

5. A blowing lance as in claim 4, including:

partitioning means in said separating means to form said chambers.

6. A blowing lance as in claim 4, wherein:

said chambers are in the shape of curved cylindrical sectors.

7. A blowing lance as in claim 6, wherein:

said chambers are semicylindrical or quarter-cylindrical sectors.

8. A blowing lance as in claim 4, wherein:

said chambers are eccentric with respect to each other and with respect to the axis of the lance.

9. A blowing lance as in claim 5 wherein said rotating means comprises servomotor means, said servomotor means being located in a space in said lance and including:

connection means for connecting said space to an inert gas source.

10. A blowing lance as in claim 1, including:

passage means in said lance for the delivery of secondary oxidixing gas.

11. A blowing lance as in claim 10, including:

passage means for delivering part of said secondary oxidizing gas to form a gas flow around the exterior of said separating means.

12. A blowing lance as in claim 1, wherein:

said separating mean has a discharge end recessed with respect to the downstream end of the lance.

13. A blowing lance for use in refining molten metal in a metallurigical vessel, the lance including:

a nozzle assembly, extending along an axis of the lance, for delivery of a gas to the molten metal;

separating means, located downstream of said nozzle assembly, to receive a gas stream from said nozzle assembly and to divide said gas stream into an even number of substantially identical gas jets for discharge from said lance at angles which are substantially equal and opposite with respect to the axis of the lance, said separating means comprising a cylinder, at least the downstream part of said cylinder being divided into an even number of equal chambers.

14. A blowing lance as in claim 13, including:

partitioning means in said separating means to form said chambers.

15. A blowing lance as in claim 13, wherein:

said chambers are in the shape of curved cylindrical sectors.

16. A blowing lance as in claim 15, wherein:

said chambers are semicylindrical or quarter-cylindrical sectors.

17. A blowing lance as in claim 13, wherein:

said chambers are eccentric with respect to each other and with respect to the axis of the lance.

18. A blowing lance as in claim 13, wherein said rotating means comprises servomotor means, said servomotor means being located in a space in said lance and including:

connection means for connecting said space to an inert gas source.

* * * * *